US010099882B2

(12) United States Patent
Lindberg et al.

(10) Patent No.: US 10,099,882 B2
(45) Date of Patent: Oct. 16, 2018

(54) METHOD OF AND AN ARRANGEMENT FOR SECURING A TRAILING END OF A WEB IN A WEB ROLL TO A SURFACE OF THE ROLL

(71) Applicants: Harri Lindberg, Järvenpää (FI); Kenneth Åkerlund, Helsinki (FI); Marko Korpinen, Hollola (FI)

(72) Inventors: Harri Lindberg, Järvenpää (FI); Kenneth Åkerlund, Helsinki (FI); Marko Korpinen, Hollola (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 166 days.

(21) Appl. No.: 14/885,941

(22) Filed: Oct. 16, 2015

(65) Prior Publication Data

US 2016/0107859 A1 Apr. 21, 2016

(30) Foreign Application Priority Data

Oct. 17, 2014 (EP) ..... 14189411

(51) Int. Cl.
*B65H 19/00* (2006.01)
*B65H 19/29* (2006.01)

(52) U.S. Cl.
CPC ... *B65H 19/29* (2013.01); *B65H 2301/41447* (2013.01); *B65H 2301/414422* (2013.01); *B65H 2301/414433* (2013.01); *B65H 2301/414866* (2013.01); *B65H 2511/512* (2013.01); *B65H 2701/12422* (2013.01)

(58) Field of Classification Search
CPC ..... B65H 19/00; B65H 19/20; B65H 19/29
See application file for complete search history.

(56) References Cited

U.S. PATENT DOCUMENTS 3,099,043 A * 7/1963 Held, Jr. ..... B29C 49/0047 264/297.7

FOREIGN PATENT DOCUMENTS

| | | | | |
|---|---|---|---|---|
| DE | 19744103 A1 | | 4/1999 | |
| EP | 0106167 A1 | | 4/1984 | |
| EP | 0512196 A1 | * | 11/1992 | ..... B65H 19/286 |
| EP | 0512196 A1 | * | 11/1992 | ..... B65H 19/286 |
| EP | 0553232 B1 | | 4/1995 | |

(Continued)

OTHER PUBLICATIONS

European Search Report for EP14189411 dated Jun. 29, 2015.

*Primary Examiner* — Michael N Orlando
*Assistant Examiner* — Matthew Hoover
(74) *Attorney, Agent, or Firm* — Stiennon & Stiennon

(57) ABSTRACT

A trailing end (14') of a web in a web roll (14, 14.1) is secured to a surface of the web roll in a slitter-winder (10) by attachment articles (30) which extend over a trailing end of the web on the roll surface. Each attachment article has an adhesive surface positioned on a path of movement of the web roll, facing toward the roll, and, while the roll is moved, it is attached on the surface of the web roll. An arrangement (11) for securing a trailing end of a web to the roll in a slitter-winder (10) has a roll handling system (24) to move the rolls (14) via a path, and an adhesive article distribution system (28) positioned to attachment the article, in which the two systems co-operate so that, as the rolls are moved, the attachment article is attached on the surface of the web roll.

10 Claims, 7 Drawing Sheets

(56) References Cited

FOREIGN PATENT DOCUMENTS

| | | | |
|---|---|---|---|
| EP | 2495195 | A2 | 9/2012 |
| JP | H06179563 | A | 6/1994 |
| WO | 9205100 | A1 | 4/1992 |
| WO | 9206912 | A1 | 4/1992 |
| WO | 2007060293 | A2 | 5/2007 |

* cited by examiner

METHOD OF AND AN ARRANGEMENT FOR SECURING A TRAILING END OF A WEB IN A WEB ROLL TO A SURFACE OF THE ROLL

CROSS REFERENCES TO RELATED APPLICATIONS

This application claims priority on European Application No. EP14189411, filed on Oct. 17, 2015, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method of securing a trailing end of a web in a web roll to a surface of the web roll in a slitter-winder with least one attachment article having an adhesive surface which extends over the trailing end of the web and onto the roll surface.

The present invention relates also to an arrangement for securing a trailing end of a web in a web roll to a surface of the web roll in a slitter-winder by setting at least one attachment article to extend over a trailing end of the web on the roll surface.

It is known that paper is manufactured in machines, which together constitute a paper-manufacturing line, which can be hundreds of meters long. Modern paper machines can produce over 450,000 tons of paper per year. The speed of the paper machine can exceed 2,000 m/min and the width of a paper web can be more than 11 meters.

In paper-manufacturing lines, the manufacture of paper takes place as a continuous process. The paper web completing in the paper machine is wound by a reel-up around a reeling shaft, i.e. reel spool, into a parent roll, the diameter of which can be even more than 5 meters and a weight of more than 160 tons. The purpose of winding is to modify the paper web manufactured as planar into a more easily processable form. On the reel-up located in the main machine line, the continuous process of the paper machine breaks for the first time and shifts into periodic operation. This periodicity is tried to be made with efficiency as good as possible in order not to waste already done work. This applies also to pulp drying machines where the dried pulp is reeled instead of cut into pulp sheets, of which pulp bales are formed.

By means of slitter-winders, a full-width web is cut in the longitudinal direction to partial webs on the cutting section and the partial webs are wound to customer rolls on the windup section. In windups, the partial webs are wound around cores to fiber web rolls and the longitudinal successive cores are locked in place to a core array by means of a core-locking device located at both ends. So called carrier roll windups are widely used in the slitter-winder, in which the partial webs are wound carried by two carrier rolls to partial web rolls via a nip between a second carrier roll and a fiber-web roll being formed. Also a belt arrangement i.e. a so-called set of belt rolls located around leading rolls can be used as the carrier roll.

In the slitter-winder in winding a fiber web, a set change means a stage in which when manufacturing rolls always before starting a new winding the winding has to be stopped, the web to be cut by the windup and the set i.e. completely wound rolls to be removed and after setting new cores the winding of the new set i.e. partial web rolls to be completed next to start again. Nowadays, the set change time in web winding is, in practice, when using machine arrangements, around 30-70 seconds from stopping the winding to its restarting.

It is known as such to use adhesive tape for securing the ends of the set of rolls. This requires a great number of so called tape dispensers arranged cross directionally the windup. Usually at least two dispensers per web roll are needed in order safely to secure the ends of the roll. Further, the tape dispensers have to be mounted on a common carrier at a suitable distance from one another corresponding to the widths of the web rolls and, in case the width of the rolls is changed, the dispensers must be positioned again to meet the new configuration.

WO 2007060293 A2 discloses a method of attaching the end of the web to the surface of the web roll by means of glue. Glue is advantageous as such and it is easy to provide automated procedures to apply glue on the web. Particularly, WO 2007060293 A2 discloses a method in winding a fiber web in connection with the set change of a slitter-winder, in which the web is cut by a cutting blade, the tails of partial webs are fastened to web rolls, completed partial web rolls are removed by means of a roll pusher and new cores are transferred to the support of the carrier rolls. In the method, when removing the completed partial web roll from the slitter-winder by the roll pusher, the main tail part of a glue stripe formed by glue applied to the end of the web is pressed finally fast in a nip between the roll pusher and the partial web roll. Respectively, the document discloses also to a device in winding a fiber web in connection with the set change of a slitter-winder, which device is arranged into connection with a carrier roll windup, which carrier roll windup comprises a rear carrier roll and a front carrier roll, carried by which the partial webs cut to partial webs by the slitter winder are wound to partial web rolls around winding tubes i.e. cores. The device comprises a roll pusher, which roll pusher is arranged to push the roll out of the windup forming a nip between the roll pusher and the completed partial web roll for the final compression of the glue stripe applied to the tail of the partial web roll. Using glue for attaching of the end of the web on the roll easily deteriorates the outer layers of the roll.

EP 0 553 232 B1 discloses a method of effecting a set change in a winder wherein the web cross-cutting apparatus and the adhesive activation apparatus are located upstream of the first winder drum, and the web severance is after the skip-slitting operation. There is also disclosed a method for cross-cutting the paper web utilizing a skip-slitting laser, applying an adhesive to the trailing and leading edges of the cross-cut paper web, and applying the trailing end to the previously wound roll and the leading edge to a new core.

Both of the above examples of prior art are also such that the end of the web is attached to the roll in the windup itself. During the time the finished rolls are still in the windup, it is impossible to start winding of the new set of rolls. Therefore these kinds of solutions are not as effective as possible.

An object of the invention is to provide a method of and arrangement for securing a trailing end of a web in a web roll in which the overall performance is considerably improved compared to the prior art solutions.

SUMMARY OF THE INVENTION

An object of the invention is substantially met by a method of securing a trailing end of a web in a web roll to a surface of the web roll in a slitter-winder for web material, such that in the method one or more attachment articles is attached to extend over a trailing end of the web on the roll surface.

It is characteristic to the invention that one or more attachment articles provided with an adhesive surface are positioned on a path of movement of the web roll, the adhesive surface of the articles toward the web roll, and while the roll is moved said one or more attachment articles are attached on the surface of the web roll.

Since said one or more attachment articles provided with an adhesive surface are positioned on a path of movement of the web roll before the web roll is moved to a position where the attachment articles are attached on the roll, the process of securing of the trailing end of the web is separated from the winding process and the overall winding process is more efficient.

In other words in the invention the distribution of the attachment articles, intended to secure the trailing ends of the web rolls, to a suitable location in a cross direction of the machine, may be performed during the time the rolls are still under winding process. This way the attachment articles are already at the right places, taking the trim lengths into account, when the set change is commenced.

According to an embodiment of the invention said one or more attachment articles are attached on the surface of the web roll substantially after the roll is moved away from the winder section of the slitter-winder.

According to an embodiment of the invention the movement is solely rotational movement where the center of the roll remains at one location and the roll is rotating on its support.

According to an embodiment of the invention the movement is rolling movement where the center of the roll moves as the roll is rolling on its stationary support.

According to an embodiment of the invention said one or more attachment articles are attached on the surface of the web while winding of a new set of rolls has been commenced in the slitter-winder. This means in practice that the securing of the trailing end to the roll is separated from the winding process and therefore the capacity of the slitter-winder is improved.

According to an embodiment of the invention the attachment articles are transferred from the support of the transport system onto the surface of a rotating web roll by simultaneously moving the transport system and moving the web roll by rotating it.

According to an embodiment of the invention the attachment articles are formed from an adhesive tape by cutting to have predetermined lengths corresponding to the length which the tape covers the trailing end of the web, and each of the attachment articles is positioned on a path of movement of the web roll to a predetermined position by a transport system prior to attaching the attachment articles on the surface of the web roll.

According to an embodiment of the invention each of the attachment articles is positioned on a path of movement of the web roll such that a leading end of the adhesive tape is dispensed from a dispenser on the transport system and the adhesive tape is cut forming a single attachment article, the attachment articles are formed one by one and transferred to a predetermined position by the transport system.

Advantageously the adhesive tape is oriented so that the length of the tape runs along the length of the trailing edge of the web covered. In other words the longitudinal direction of the tape is parallel with the central axis of the roll.

According to an embodiment of the invention in the method the transport system is first moved to a first position at which the leading end of the adhesive tape is dispensed from the dispenser on the transport system and the attachment articles are formed at the predetermined positions and being supported by the transport system, and subsequently the transport system is moved to a second position at which the act of attachment of said one or more attachment articles on the surface of the web roll is commenced. The first and the second positions are separate locations.

According to an embodiment of the invention in the method the transport system is first moved to one of several optional first positions at which the tape dispenser is arranged. This means in practice that there may be separate dispensers to utilize increasing the redundancy of the slitter-winder.

According to an embodiment of the invention the attachment articles are attached on the surface of each of the web rolls in the set simultaneously.

According to an embodiment of the invention the tape dispenser is attached to the transport system and moved along with the transport system.

According to an embodiment of the invention one surface of the attachment article is provided with readable information readable outwards on the surface of the roll after attachment on the roll. Advantageously the readable information contains roll specific information. The attachment article may be at least partially visible, in which case the information may be behind the article. If the attachment article is not visible the readable information, particularly if human readable, is on the surface remaining on an outer side when attached to the roll. The readable information may be also such that it is invisible to humans but still readable by a computer system.

According to an embodiment of the invention the readable information is on the attachment article while dispensing the adhesive tape from the dispenser.

An object of the invention is also met by an arrangement for securing a trailing end of a web in a web roll to a surface of the web roll in a slitter-winder for web material by setting one or more attachment articles to extend over a trailing end of the web on the roll surface, comprising a roll handling system arranged to move the set of rolls via a predetermined path of movement, the adhesive article distribution system arranged to position one or more attachment articles provided with an adhesive surface on said path of movement of the web roll.

It is characteristic to the invention that the adhesive article distribution system and the roll handling system are arranged in cooperation with each other such that while the set of rolls is moved, said one or more attachment articles are attached on the surface of the web roll.

This way the movement of the roll is utilized in attaching all needed attachment articles simultaneously to each roll of the set.

According to an embodiment of the invention the article distribution system comprises a transport system which transport system is provided with retaining means for adhesive articles. The transport system extends over the width of the winder so that each roll of the set may be handled simultaneously.

According to an embodiment of the invention the article distribution system comprises a number of tape dispensers arranged to different positions at the working area of the adhesive distribution system.

According to an embodiment of the invention the article distribution system comprises tape dispensers arranged on both ends of the transport system.

According to an embodiment of the invention the adhesive article distribution system and the roll handling system are arranged in co-operation with each other such that while the set of rolls is moved by rotating it at one location, said one or more attachment articles are attached on the surface of the web roll.

According to another embodiment of the invention the adhesive article distribution system and the roll handling system are arranged in co-operation with each other such that while the set of rolls is moved while rotating it on a support surface, said one or more attachment articles are attached on the surface of the web roll.

The article distribution system may be arranged also to a location farther from the slitter-winder e.g. between two conveyor sections. In that case the article distribution system needs to have a roll handling system which facilitates the operation of the arrangement for securing a trailing end of a web in a web roll.

According to an embodiment of the invention the arrangement comprises a control system which is provided with executable instructions to operate the adhesive article distribution system and the roll handling system and/or the slitter-winder such that while the set of rolls is moved, said one or more attachment articles are attached on the surface of the web roll.

The control system may be a computer system provided with an output unit arranged to transmit operational instructions, generated by running executable instructions, to the slitter-winder and the adhesive article distribution system.

The control system is advantageously provided with executable instructions to rotate the set of rolls in the slitter-winder, after the partial webs have been cut, to such a rotational position that when the roll has rolled to the working area of the adhesive article distribution system, the trailing end of the web is at a position where the adhesive article distribution system is capable of attaching said one or more attachment articles on the surface of the web roll to extend over the trailing end of the web on the roll surface.

According to an embodiment of the invention the control system is provided with executable instructions to select a dispenser containing a tape having a width which is selected based on the roll related information, such as grammage and/or surface quality of the web in the roll.

An object of the invention according to another aspect of the invention is substantially met by a method of securing a trailing end of a web in a web roll to a surface of the web roll in a slitter-winder for web material, such that in the method one or more attachment articles is attached to extend over a trailing end of the web on the roll surface. In the one or more attachment articles provided with an adhesive surface are positioned on a path of movement of the web roll, the adhesive surfaces of the articles toward the web roll, and said one or more attachment articles are attached on the surface of the web roll, and one surface of the attachment article is provided with readable information readable outwards on the surface of the roll after attachment on the roll.

Advantageously the readable information contains roll specific information. The attachment article may be at least partially visible, in which case the information may be behind the article. If the attachment article is not visible the readable information, particularly if human readable, is on the surface remaining on an outer side when attached to the roll. The readable information may be also such that it is invisible to humans but still readable by a computer system.

According to an embodiment of the invention the readable information is printed on the attachment article while dispensing the adhesive tape from the dispenser.

An object of the invention according to another aspect of the invention is substantially met by an arrangement for securing a trailing end of a web in a web roll to a surface of the web roll in a slitter-winder for web material by setting one or more attachment articles to extend over a trailing end of the web on the roll surface, comprising a roll handling system arranged to move the set of rolls via a predetermined path of movement, an adhesive article distribution system is arranged to position one or more attachment articles provided with an adhesive surface on said path of movement of the web roll. It is characteristic to the invention that at least one of the attachment articles is provided on one surface of the attachment article with readable information readable outwards on the surface of the roll after attached on the roll.

Advantageously the readable information contains roll specific information. The attachment article may be at least partially visible, in which case the information may be behind the article. If the attachment article is not visible the readable information, particularly if human readable, is on the surface remaining on an outer side when attached to the roll. The readable information may be also such that it is invisible to humans but still readable by a computer system.

In this description, the term core means various types of winding tubes used and suitable for use in windups. Furthermore in this description, partial webs being wound on the windup and web rolls being formed are referred to, according to context, either in singular or plural but meaning all partial webs and web rolls handled in the winder. Also the winder is referred to either as slitter-winder or winder, but in this context both of these may be used because the essence of the invention relates to securing the trailing end of the web on the surface of an already wound roll.

According to an embodiment of the invention, a method is practiced for securing a trailing end of a pulp web roll to a surface of the web roll in a slitter winder for pulp web material, such that in the method one or more attachment articles is attached to extend over a trailing end of the web on the roll surface, characterized in that one or more attachment articles provided with an adhesive surface are positioned on a path of movement of the web roll, the adhesive surface of the articles toward the web roll, and while the roll is moved said one or more attachment articles are attached on the surface of the web roll.

The invention provides several benefits. For example the securing of the trailing end of the web is separated from the winding process and in this way the available capacity of the winder may be increased. Additionally, the coverage area of the adhesive article may be adjusted in continuous manner, and the location of the adhesive article may be selected substantially freely between the ends of the roll.

Further, it is possible to mark the roll with a label making use of the adhesive article according to an embodiment of the invention.

The arrangement according to the present invention is very versatile since use of several tape widths is possible. Additionally, several dispensers give redundancy to the process. The tape suitable for use in the present invention is such that it has adhesive material only on its one side. The present invention is also applicable to various types of winders, such as two-drum winders and single-drum winders.

The present invention is also applicable to handling various types of paper and board grades as well as pulp. Paper and board are available in a wide variety of types and can be divided according to basis weight into two grades: papers with a single ply and a basis weight of 25-300 g/m$^2$ and boards manufactured in multi-ply technology and having a basis weight of 150-600 g/m$^2$. It should be noted that the borderline between paper and board is flexible since board grades with the lightest basis weights are lighter than the heaviest paper grades. Generally speaking, paper is used for printing and board for packaging.

The subsequent descriptions are examples of values presently applied for fibrous webs, and there may be considerable fluctuations from the disclosed values. The descriptions are mainly based on the source publication, Papermaking Science and Technology, section Papermaking Part 3, edited by Jokio, M., published by Fapet Oy, Jyväskylä 1999, 361 pages.

Mechanical-pulp based, i.e. wood-containing printing papers include newsprint, uncoated magazine and coated magazine paper.

Newsprint is composed either completely of mechanical pulp or may contain some bleached softwood pulp (0-15%) and/or recycled fiber to replace some of the mechanical pulp. General values for newsprint can probably be regarded as follows: basis weight 40-48.8 g/m$^2$, ash content (SCAN-P 5: 63) 020%, PPS S10 roughness (SCAN-P 76-95) 3.0-4.5 μm, Bendtsen roughness (SCAN-P21: 67) 100-200 ml/min, density 600-750 kg/m$^3$, brightness (ISO 2470: 1999) 57-63%, and opacity (ISO 2470: 1998) 90-96%.

Uncoated magazine paper (SC=supercalendered) usually contains mechanical pulp to 50-70%, bleached softwood pulp to 10-25%, and fillers to 15-30%. Typical values for calendered SC paper (containing e.g. SC-C, SCB, and SC-A/A+) include basis weight 40-60 g/m$^2$, ash content (SCAN-P 5: 63) 0-35%, Hunter gloss (ISO/DIS 8254/1)<20-50%, PPS S10 roughness (SCAN-P 76: 95) 1.0-2.5 μm, density 700-1250 kg/m$^3$, brightness (ISO 2470: 1999) 6270%, and opacity (ISO 2470: 1998) 90-95%.

Coated magazine paper (LWC=light weight coated) contains mechanical pulp to 40-60%, bleached softwood pulp to 25-40%, and fillers and coating to 20-35%. General values for LWC paper can be regarded as follows: basis weight 40-70 g/m$^2$, Hunter gloss 50-65%, PPS S10 roughness 0.8-1.5 μm (offset) and 0.6-1.0 μm (roto), density 1100-1250 kg/m$^3$, brightness 70-75%, and opacity 89-94%.

General values for MFC paper (machine finished coated) can be regarded as follows: basis weight 50-70 g/m$^2$, Hunter gloss 25-70%, PPS S10 roughness 2.2-2.8 μm, density 900-950 kg/m$^3$, brightness 70-75%, and opacity 91-95%.

General values for FCO paper (film coated offset) can be regarded as follows: basis weight 40-70 g/m$^2$, Hunter gloss 45-55%, PPS S10 roughness 1.5-2.0 μm, density 1000-1050 kg/m$^3$, brightness 70-75%, and opacity 91-95%.

General values for MWC paper (medium weight coated) can be regarded as follows: basis weight 70-90 g/m$^2$, Hunter gloss 65-75%, PPS S10 roughness 0.6-1.0 μm, density 1150-1250 kg/m$^3$, brightness 70-75%, and opacity 89-94%.

HWC (heavy weight coated) has a basis weight of 100-135 g/m$^2$ and can be coated even more than twice.

Pulp-produced, wood-free printing papers or fine papers include uncoated and coated pulp-based printing papers, in which the portion of mechanical pulp is less than 10%.

Uncoated pulp-based printing papers (WFU) contain bleached birch wood pulp to 55-80%, bleached softwood pulp to 0-30%, and fillers to 10-30%.

The values with WFU are highly unstable: basis weight 50-90 9/m$^2$ (up to 240 g/m$^2$), Bendtsen roughness 250-400 ml/min, brightness 86-92%, and opacity 83-98%.

In coated pulp-based printing papers (WFC), the amounts of coating vary widely in accordance with requirements and intended application. The following are typical values for once- and twice-coated, pulp-based printing paper: once-coated basis weight 90 g/m$^2$, Hunter gloss 65-80%, PPS S10 roughness 0.75-2.2 μm, brightness 80-88%, and opacity 91-94%, and twice-coated basis 10 weight 130 g/m$^2$, Hunter gloss 70-80%, PPS S10 roughness 0.65-0.95 brightness 83-90%, and opacity 95-97%.

Release papers have a basis weight within the range of 25-150 g/m$^2$.

Other papers include e.g., sackkraft papers, tissues, and wallpaper bases.

Board making makes use of chemical pulp, mechanical pulp and/or recycled pulp. Boards can be divided e.g. in the following main groups according to applications thereof.

Corrugated board, comprising a liner and a fluting.

Boxboards, used for making boxes, cases. Boxboards include e.g., liquid packaging boards (FBB=folding boxboard, LPB=liquid packaging board, WLC=white-lined chipboard, SBS=solid bleached sulfite, SUS=solid unbleached sulfite).

Graphic boards, used for making e.g. cards, files, folders, cases, covers, etc.

Wallpaper bases.

As can be appreciated from the above, there is a wide range of paper and board grades, and a multitude of various machines are used for making the same.

BRIEF DESCRIPTION OF THE DRAWINGS

In the following, the invention will be described with reference to the accompanying exemplary, schematic drawings.

DESCRIPTION OF THE PREFERRED EMBODIMENTS

Figure 1:
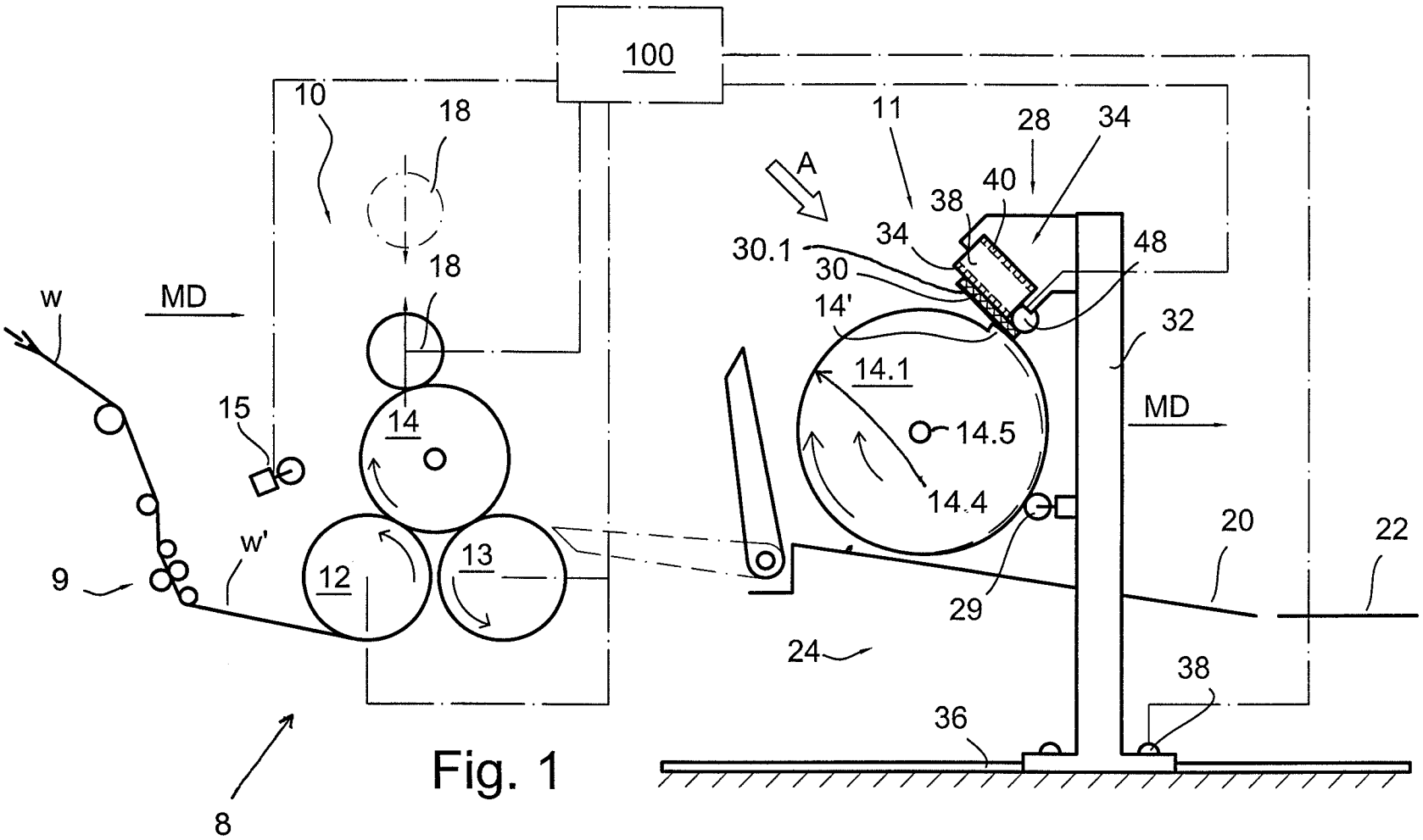
FIG. 1 illustrates a slitter-winder according to an embodiment of the invention.

FIG. 1 depicts schematically a slitter-winder 10 which is of the two-drum type. The slitter-winder comprises two carrier rolls 12,13 and a press device, here being a press roll 18, as its main components. At least the press roll is arranged movable such that it may follow the growing set of rolls 14 while supporting them from above. The carrier rolls 12, 13 and the press roll 18 are used to rotatably support the set of web rolls 14 being wound to be so called customer rolls. The slitter-winder is also provided with a slitting section 9 arranged to slit the running web w into multiple partial webs w', as is known in the art as such.

When the set of rolls is ready the partial webs w' are cut (not shown) and the set of rolls are removed from the winder 10 by moving the set of rolls in a machine direction MD, meaning a general direction of running w in the system. The winder 10 is provided with a pusher device 15 for moving the set of rolls out of the winder 10. In FIG. 1 there is shown a situation where a first set of rolls 14.1 has already been wound to their full diameter and has been moved out of the winder 10 while winding of a new set of rolls 14 has begun. As is obvious, when the partial web w' is cut there is a trailing end of the web 14' in the roll 14.1 which needs to be secured on the surface 14.4 of the roll so that the roll will not unwind or become loose.

The slitter-winder 10 is provided with an arrangement 11 for securing a trailing end 14' of a web w' of each roll 14 in the set. The arrangement 11 for securing a trailing end 14' of a web w' comprises a roll handling system 24 which is provided in the embodiment of FIG. 1 with a sloping support surface 20. The roll handing system 24 defines a path of movement of the rolls 14 by means of its surface 20. That is because in this embodiment the rolls are moved be controllably rotating the roll along the support surface 20. This provides a straight forward means for moving the roll 14.1 forwards from the winder 10 while the arrangement 11 for securing a trailing end 14' of a web w' is operated to secure the trailing end of the web in the roll. In FIG. 1 the first set of rolls 14.1 is on the sloping support surface 20 belonging to the arrangement 11. The support surface 20 may lead for example to a conveyor 22 for further handling the processed rolls. A trailing end 14' of the partial web w' in the roll 14.1 is shown in an extremely exaggerated manner for illustrative purposes only. The arrangement for securing a trailing end 14' of a web w' is provided with an adhesive article distribution system 28, which is arranged to position one or more adhesive articles 30 on the path of movement of the web roll 14.1, such that the adhesive articles 30 may be attached on the web rolls 14.1. The arrangement 11 for securing a trailing end 14' of a web w' is provided with support roll 29 or a like against which the set of rolls 14.1 may be rested while the roll are rolled on the sloping surface 20.

The adhesive articles 30 are preferably formed by cutting suitable pieces from an adhesive tape provided with an adhesive surface 30.1 on its one side and placed on the path of movement of the web roll 14.1 as will be explained later. Each of the attachment articles 30 is positioned on a path of movement of the web roll 14.1 to a predetermined position by a transport system 34 prior to attaching the attachment articles 30 on the surface 14.4 of the web roll. The transport system is arranged to move each of the adhesive article 30 in the cross direction to a predetermined position.

The adhesive article distribution system 28 and the roll handling system 24 are arranged in co-operation with each other such that while the set of rolls 14.1 is moved, said one or more attachment articles 30 are attached on the surface 14.4 of the web roll 14.1. Thus, the arrangement is provided with a control system 100 which is provided with executable instructions to operate the adhesive article distribution system 28 and the roll handling system 24 and/or the slitter-winder 10 such that while the set of rolls 14.1 is moved, said one or more attachment articles 30 are attached on the surface of the web roll 14.1. The control system may be a computer system provided with an output unit arranged to transmit operational instructions, generated by running executable instructions, to the slitter-winder 10 and the adhesive article distribution system 28.

According to an embodiment of the invention the control system 100 is provided with executable instructions to rotate the set of rolls 14 in the slitter-winder 10, after the partial webs have been cut, to such a rotational position that when the roll 14.1 has rolled to the working area of the adhesive article distribution system 28, the trailing end of the web 14' is at a position where the adhesive article distribution system 28 is capable of attaching said one or more attachment articles 30 on the surface 14.4 of the web roll to extend over the trailing end 14' of the web on the roll surface. This way the slitter-winder 10 rotates the set of rolls 14 to the position which, taken the diameter of the rolls and the distance to rotate to the position where the transport system is waiting to come in contact with the surface 14,4 of the roll such that the adhesive article may secure the trailing end 14' of the web to the roll 14.1.

The arrangement for securing a trailing end of a web of each roll in the set may advantageously be used for practicing a method of securing a trailing end 14' of a web in a web roll 14, 14.1 to a surface 14.4 of the web roll in a slitter-winder 10 for web material. According to an embodiment of the invention in the method one or more attachment articles are set to extend over a trailing end of the web 14' on each roll surface 14.4 so that the roll will not be unwound or become loose. Firstly, in the method one or more attachment articles 30 are positioned on a path of movement of the web roll 14.1 such that the adhesive surface 30.1 of the articles is facing toward the web roll, and while the roll 14.1 is moved further one or more attachment articles 30 are attached on the surface 14.4 of the web roll 14.1.

In the embodiment of FIG. 1 the one or more attachment articles 30 are transferred from the support of a transport system 34 and attached onto the surface 14.4 of the web roll 14.1 while the roll is moved away from the winder part 10 of the slitter-winder 8 by rotational movement. Simultaneously the transport system 34 is moved respectively to allow the movement of the roll 14.1 and facilitate the attachment of the adhesive articles 30.

Also, according to an embodiment of the invention said one or more attachment articles 30 are attached on the surface 14.4 of the web w' while winding of a new set of rolls 14 is commenced in the winder 10. This increases the capacity of the system remarkably since the slitting operation may be commenced immediately after the roll has been released from the winding section.

Figure 2:
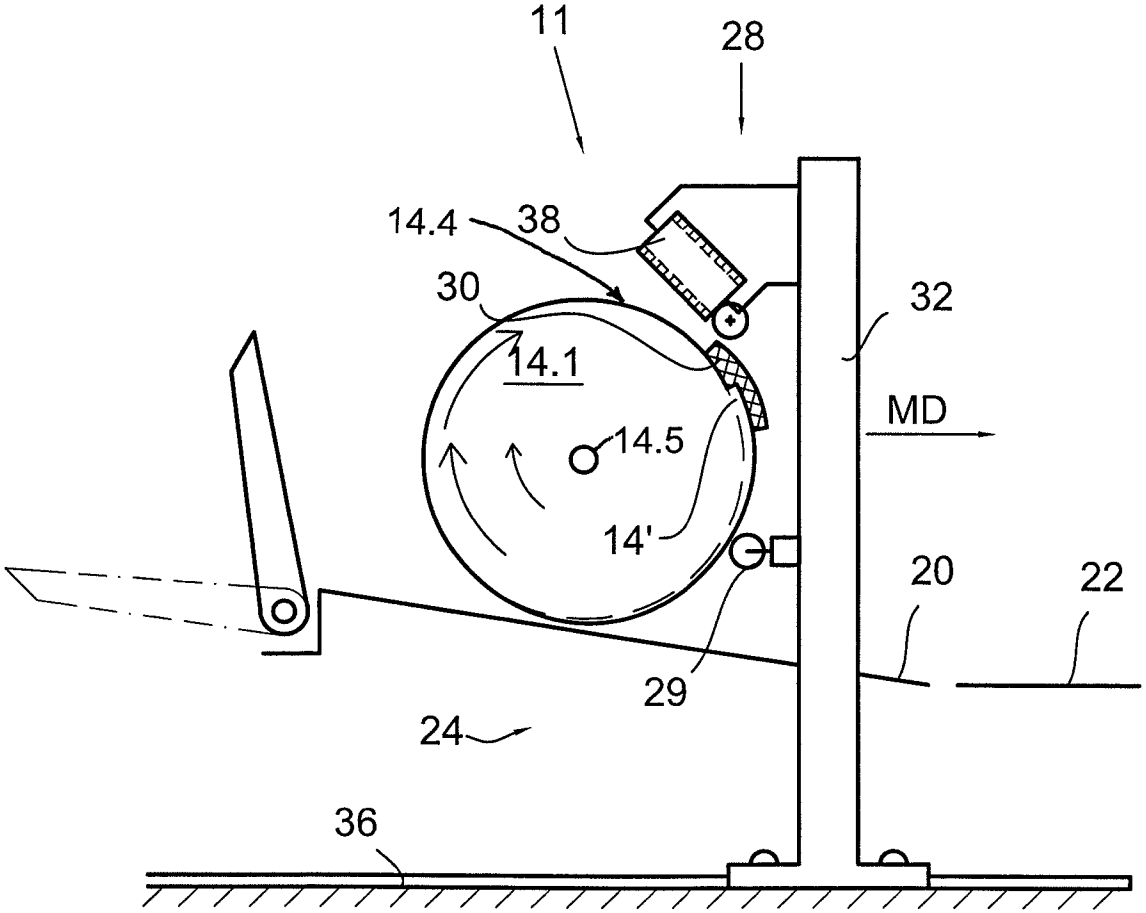
FIG. 2 illustrates an arrangement according to FIG. 1 in a different operational position.

In FIG. 2 there is shown the arrangement of FIG. 1 in a situation where one or more attachment articles 30 have been attached on the web roll 14.1 binding the trailing end 14' on the surface 14.4 of the web roll, in strongly exaggerated manner.

Figure 3:
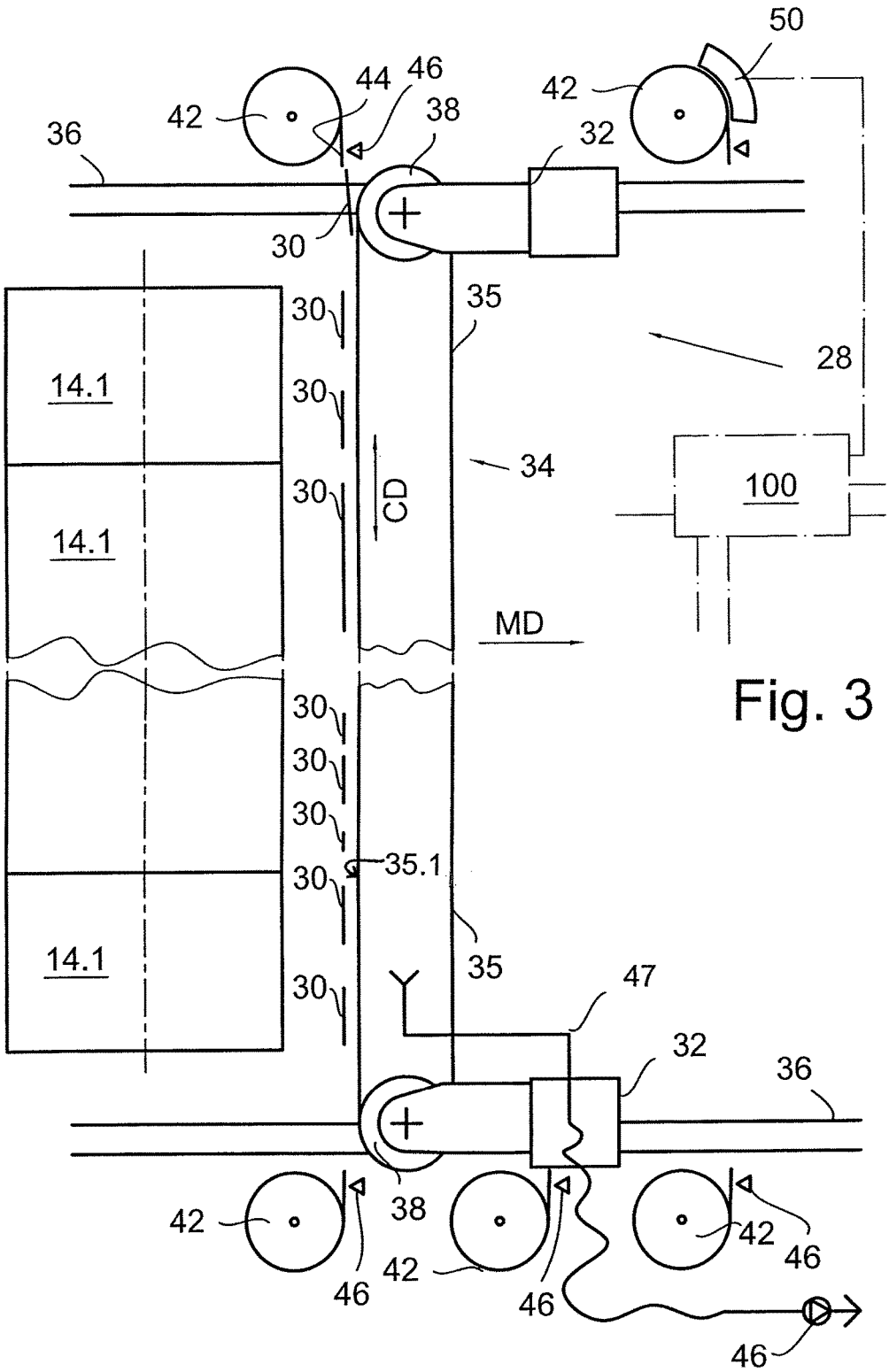
FIG. 3 illustrates a view of a slitter-winder according FIG. 1.

In the following the adhesive article distribution system 28 according to an embodiment of the invention is explained with reference to FIGS. 1 and 3, which FIG. 3 illustrates a view of the arrangement 11 in the direction of arrow A in FIG. 1. The adhesive article distribution system 28 comprises a frame part 32 which is arranged movable in respect to the winder 10. The frame part 32 is supported on e.g. a rail or a guide 36 arranged on front side and back side floor. The frame part 32 is further provided with an actuator 38 such as a motor to move the frame part 32. The actuator 38 is made subject to control of the control system 100. The frame part may be also a subsection of a bigger frame system and the movement may be accomplished also by an appropriate pivoting arm system.

There is a transport system 34 arranged in connection with the frame part 32. The transport system 34 is arranged to extend in the direction of the center axis of the rolls, i.e. in a cross direction CD over the total length of the successive rolls 14.1 in the set. The transport system 34 is provided with a support member 35, such as an endless belt, arranged to run around two guide rolls 38. At least one of the guide rolls is provided with a controllable drive (not shown), which is made subject to control of the control system 100. By rotating the guide rolls 38 the support member 35 may be moved in the cross direction, in either direction, as desired. In the embodiment of FIGS. 1 and 3 the support member 35 is provided with openings 40 via which an under pressure is provided by e.g. a vacuum system 47 under the support member is arranged to effect on the attachment articles 30 such that they are firmly enough maintained on the surface 35.1 of the support member 35. The openings 40 may be provided by means of perforation, punctured hole or even by making the support member of woven or meshed wire. The adhesive distribution system 28 may be provided with an additional pressing device 48 extending in the cross direction for improving the securing of the trailing end 14' of the web w' onto the surface 14.4 of the web roll 14.1 by applying an extra force on the adhesive article 30.

In FIG. 3 there is shown an adhesive distribution system 28 which comprises a number of dispensers 42 arranged to the working area of the adhesive article distribution system 28. The dispensers 42 are provided with tape material for providing the adhesive articles 30. The dispensers 42 are also provided with a cutting device 46 for cutting the tape material. The attachment articles 30 are formed from an adhesive tape stored in the dispenser 42 by administrating tape of a suitable length and cutting it to have predetermined lengths corresponding to the length which the tape covers the trailing end of the web w' on the roll 14.1. A dispenser may contain several tapes of different width and/or e.g. adhesive quality, or each dispenser may contain tape of only one kind in which case there are a number of dispensers each having tape of different quality or kind. Providing a number of dispensers increases also the redundancy of the system, because there is always available a spare dispenser should any one of the dispensers fail. The adhesive distribution system 28 may be moved to co-operate with any one of the dispensers 42 for positioning the attachment articles 30 on the support member 35 of the transport system 34. The arrangement is operated so that each of the attachment articles 30 is positioned on the support member 35 such that a leading end of the adhesive tape 44, which may be stored in a roll of tape, is dispensed from a dispenser 40 on the transport system 34, particularly on its support member 35, and the adhesive tape is cut forming a single attachment article, the attachment articles are formed one by one and transferred to a predetermined position by the transport system. The attachment articles 30 may be brought onto the support member from either of the ends of the transport system 34.

According to an embodiment of the invention the control system 100 is provided with executable instructions to select a dispenser containing a tape having a width which is selected based on the roll related information, such as grammage and/or surface quality of the web in the roll. Typically the heavier/more slippery the web is the wider tape should be used. It should be understood that the width of the tape corresponds to the length of the angular coverage of the attachment article 30 on the roll 14.1.

Figure 4:
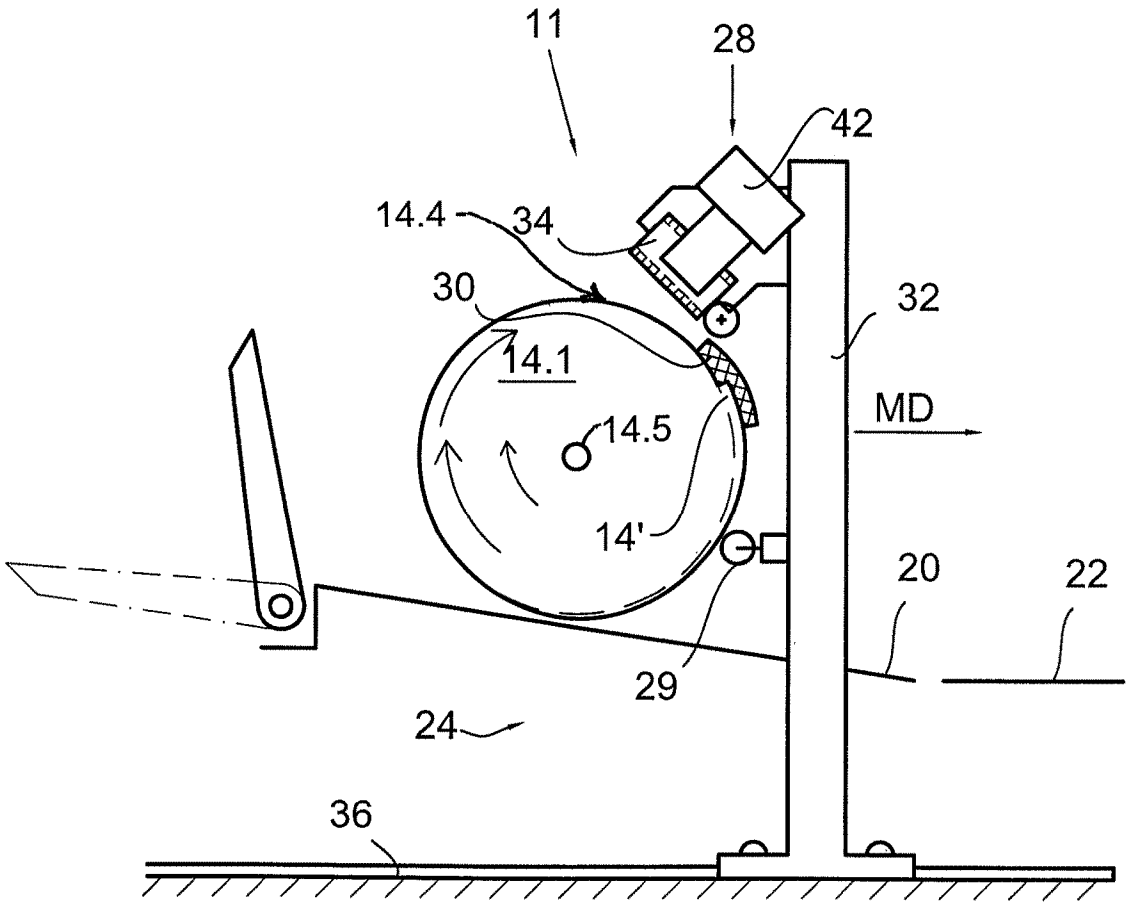
FIG. 4 illustrates an article distribution system according to another embodiment of the invention.

FIG. 4 discloses an embodiment where there is a dispenser 42 arranged at one or both ends of the adhesive article distribution system 28. In this embodiment one or two dispensers are integrated to the adhesive article distribution system 28 i.e. moved along with the transport system 34 and there is no need to move the adhesive article distribution system 28 for retrieving the attachment articles 30 on the support member 35.

Figure 5:
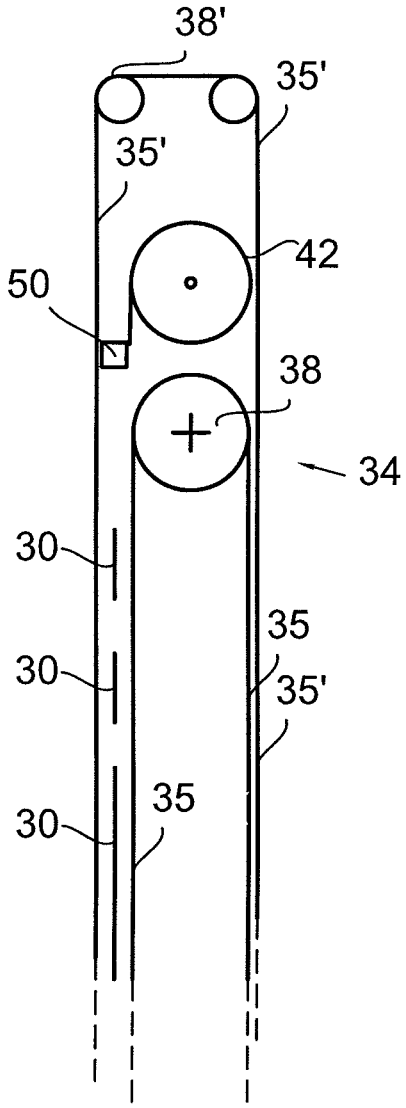
FIG. 5 side elevation view of article distribution system according to another embodiment of the invention.
Figure 6:
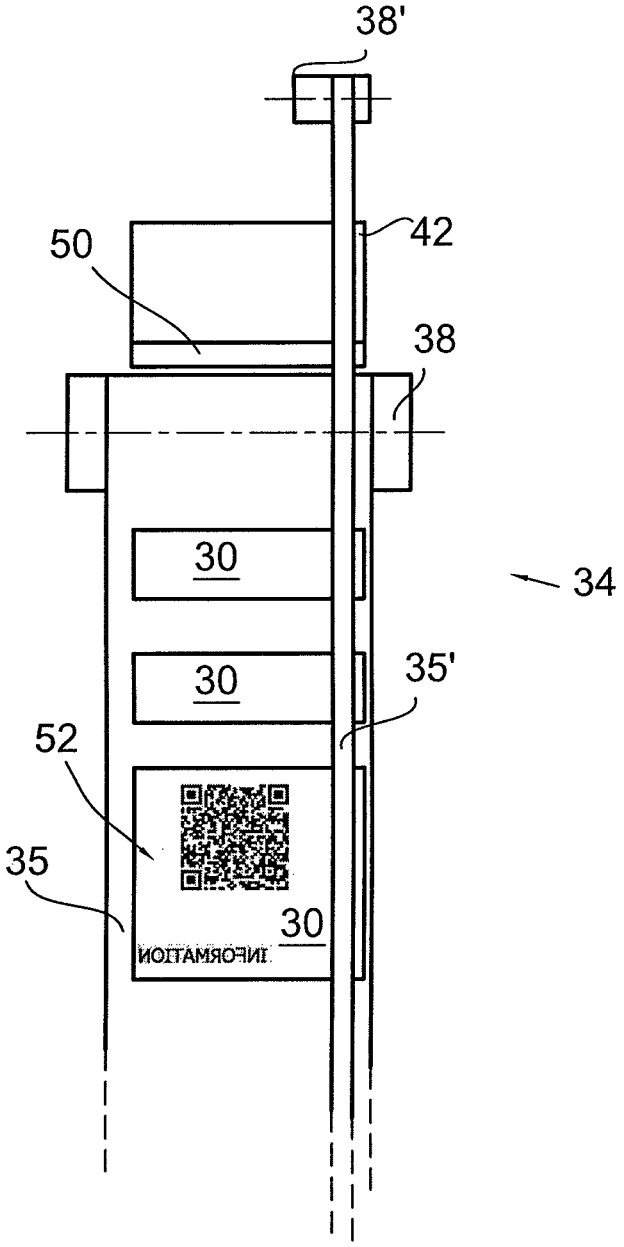
FIG. 6 top plan view of article distribution system of FIG. 5

In FIGS. 5 and 6 there is disclosed an embodiment of the invention, which relates to the transport system 34 of the adhesive article distribution system 28. In this embodiment the transport system comprises in addition to the support member 35 an auxiliary support member 35' arranged to run against the support member 35 at least on the side of the transport system 34 where the attachment articles 30 are positioned. The auxiliary support member 35' is guided via rollers 38' around the support member 35. The auxiliary support member 35' is a retaining means arranged to retain the attachment articles on a correct position by pressing against the support member 35. The auxiliary support member 35' may be a sole means for retaining the attachment articles 30 on a correct position or it may for assisting the effect of the under pressure behind the support member 35.

Figure 7:
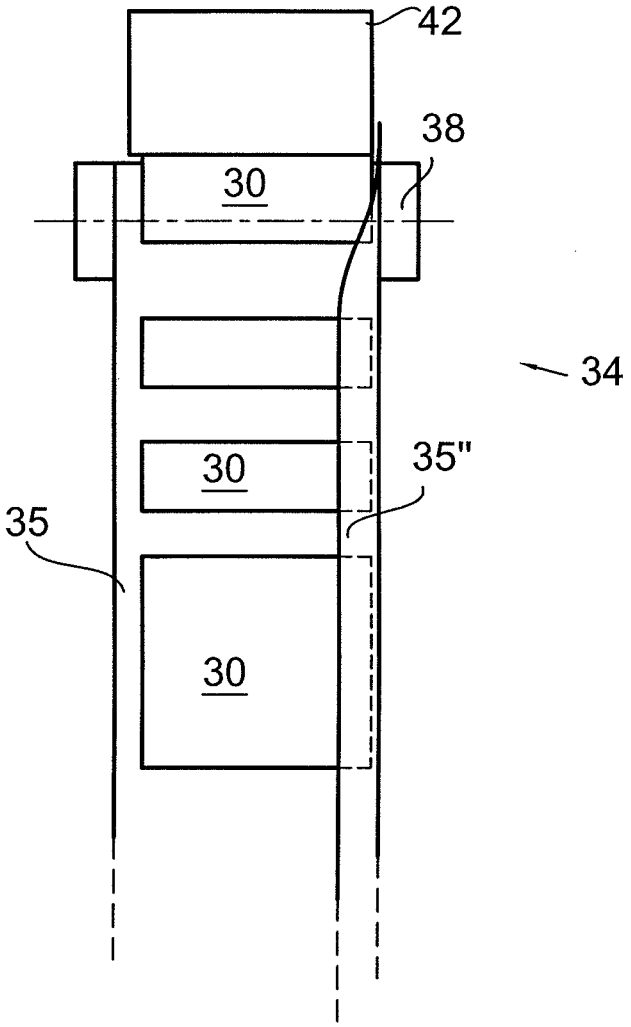
FIG. 7 illustrates a transport system according to still another embodiment of the invention.

In FIG. 7 there is disclosed an embodiment of the invention, which relates to the transport system 34 of the adhesive article distribution system 28. In this embodiment the transport system comprises a folded edge 35" in the support member 35 arranged to run against the support member 35 at least on the side of the transport system 34 where the attachment articles 30 are positioned. The folded edge 35" is guided such that it is opened at the end, where the attachment articles 30 are guided and inserted under the folded edge to retain the attachment articles on a correct position by pressing against the support member.

In the embodiments of FIGS. 5 and 6 the attachment articles are such that the area which is covered by the auxiliary support member or the pleated edge is free of adhesive.

Now referring back to FIGS. 3 and 5, according to an embodiment of the invention the adhesive distribution system 28, advantageously the dispenser 42 is provided with a marking system 50 arranged to provide the attachment article with readable information 52, an example of which is shown in FIG. 5. The readable information may be computer readable, such as a bar code or quick response code, or human readable information, such as writing or a symbol or both. It is to be noted that the readable information is in FIG. 6 behind the attachment article and is visible here when the attachment article is transparent. The readable information comprises advantageously roll specific information. The marking system may be for example a printer arranged to print the readable information on the attachment article while dispensing the adhesive tape from the dispenser 42. It is to be noted that the marking system may be applied or used independent from the manner with which the roll is moved.

Figure 8:
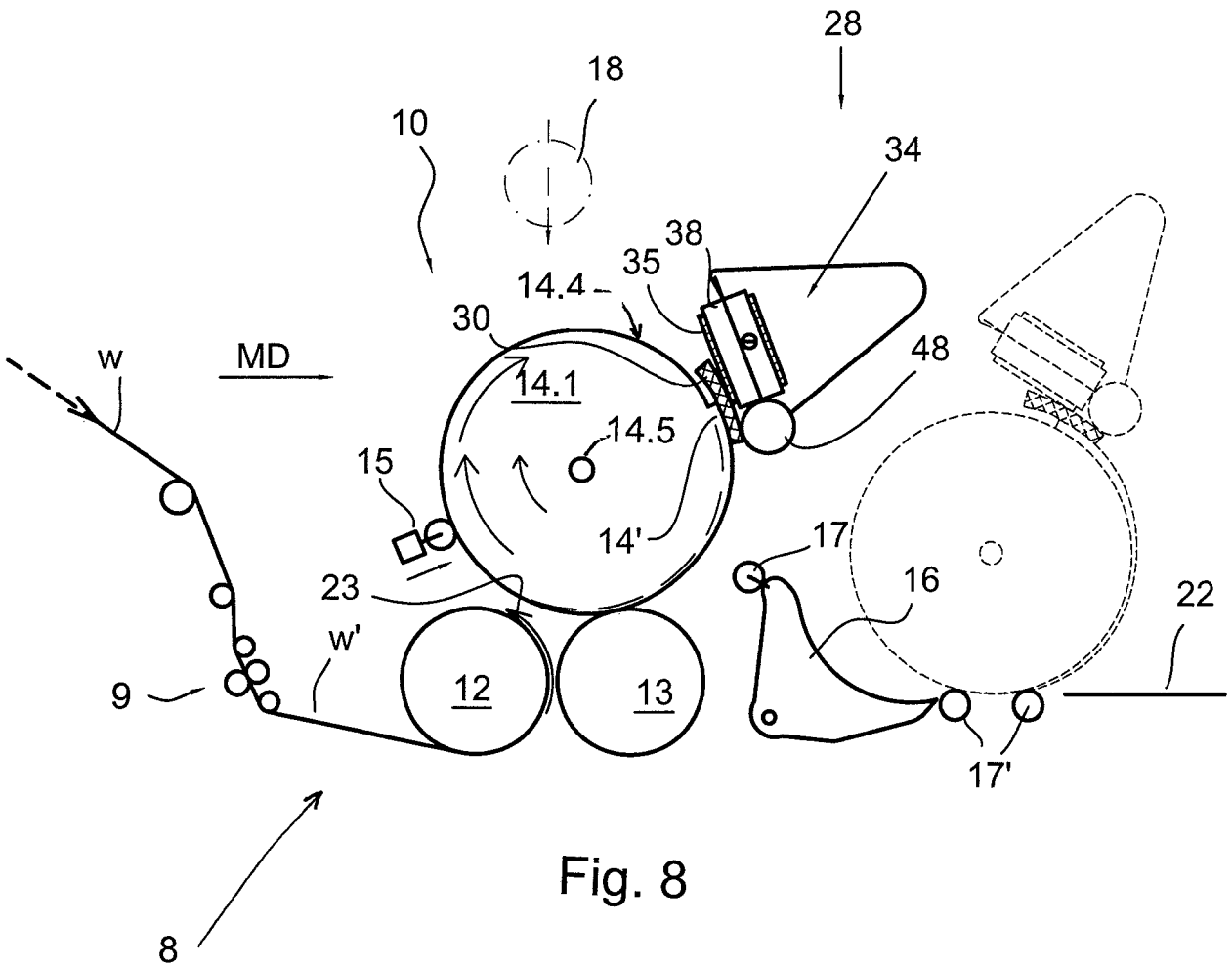
FIG. 8 illustrates an article distribution system according to another embodiment of the invention.

In FIG. 8 there is shown an exemplary embodiment of the invention where the method is practiced while the set of rolls 14.1 is supported by one of the carrier rolls 12, 13 of the winder 10. The transport system 34 for the adhesive articles 30 is similar to that explained in connection with FIG. 1.

Here the web rolls 14.1 are rotatably supported by the pushing device 15 and the front roll 13 winder, while the end of the still unwound partial webs w' are retained against the rear roll 12 by a cutting/retaining device 23, the roll 12 being now at a halted state. In this embodiment the movement of the rolls 14.1 while the trailing end 14' of the web is secured on the surface 14.4 of the web roll 14.1, is solely rotational movement where the center 14.5 of the roll remains at one location and the roll is rotating on its support.

As an optional measure the roll 14.1 may also be rotated under support of the front roll 13 and a support element 17 arranged to a roll removal device 16 of the winder 10. The support element 17 can comprise, for example, one or more rollers or corresponding arranged in connection with the removal device 16, supported by which the roll 14 can safely be rotated.

It is also conceivable that the trailing end of the web is secured on the surface of the roll 14.4, at a dedicated roll rotating station arranged in the roll transportation system downstream the winder 10. This is depicted by rollers 17' in FIG. 8 between the removal device 16 and a conveyor 20. Such a dedicated roll rotating station may be arranged also between two conveyor sections. Also in this case it is solely rotational movement where the center 14.5 of the roll 14.1 remains at one location and the roll is rotating on its support 17', that is needed for operating the transport system 34 practicing the method according to the invention.

While the invention has been described herein by way of examples in connection with what are, at present, considered to be the most preferred embodiments, it is to be understood that the invention is not limited to the disclosed embodiments, but is intended to cover various combinations or modifications of its features, and several other applications included within the scope of the invention, as defined in the appended claims. The details mentioned in connection with any embodiment above may be used in connection with another embodiment when such combination is technically feasible.

We claim:

1. A method in a slitter-winder for web material, comprising the steps of:

for each of a plurality of web rolls in a set of rolls securing a trailing end of a web which forms each web roll, to a surface of each corresponding web roll, with one of a plurality of attachment articles each having an adhesive surface, by transporting the plurality of attachment articles each having an adhesive surface on a transport system which moves in a cross machine direction to a predetermined cross directional position; and positioning each attachment article on the transport system at a predetermined cross directional position so that each corresponding adhesive surface is positioned on one of a plurality of paths along which each corresponding web roll moves, with each corresponding adhesive surface toward each corresponding web roll, and while each corresponding web roll is moved along each corresponding path, attaching each corresponding attachment article on the corresponding surface of the trailing end of each corresponding web and each corresponding surface of each web roll.

2. The method of claim 1 wherein each of the plurality of attachment articles is attached on the corresponding surface of the corresponding trailing end of the corresponding web and the corresponding surface of the corresponding web roll while winding of a new set of rolls has been commenced in the slitter-winder.

3. The method of claim 1 wherein the plurality of the attachment articles are transferred simultaneously from being supported on the transport system onto the corresponding surface of each of the plurality of web rolls in the set of web rolls while each of the plurality of web rolls is rotating, by simultaneously moving the transport system.

4. The method of claim 1 wherein each of the attachment articles is formed by an adhesive tape dispensed from a tape dispenser on to the transport system and the adhesive tape is cut to form each of the plurality of attachment articles, the attachment articles being formed one by one and transferred on to a predetermined position by the transport system so that at the predetermined cross directional position each corresponding adhesive surface is positioned on one of the plurality of corresponding paths along which each corresponding web roll moves.

5. The method of claim 4 wherein the transport system is first moved to a first position at which a leading end of the adhesive tape is dispensed from the tape dispenser on the transport system and the attachment articles are formed one after another at the predetermined positions and supported by the transport system, and subsequently the transport system is moved to the predetermined position at which the operation of attachment of said attachment articles on the surface of the trailing end of the webs and the surfaces of the web rolls is commenced.

6. The method of claim 5 wherein the transport system is first moved to one of several first positions at which the tape dispenser is arranged.

7. The method of claim 3 wherein a tape dispenser is moved along with the transport system.

8. The method of claim 1 wherein one surface of the at least one attachment article is provided with readable information visible outwards on the surface of the roll after being attached on the roll.

9. The method of claim 8 wherein the readable information is printed on the adhesive surface of the at least one attachment article while dispensing the at least one attachment article as an adhesive tape from a tape dispenser.

10. The method of claim 1 wherein the transporting of the at least one attachment article to the predetermined cross directional position is on an endless belt forming at least part of the transport system.

* * * * *